US005256183A

United States Patent [19]

Ruch et al.

[11] Patent Number: 5,256,183

[45] Date of Patent: Oct. 26, 1993

[54] PROCESS FOR PRODUCTION OF REINFORCED COMPOSITE MATERIALS AND PRODUCTS THEREOF

[75] Inventors: Wolfgang W. Ruch, Logumkloster, Denmark; Lars Auran, Sunndalsora; Nils Ryum, Trondheim, both of Norway

[73] Assignee: Norsk Hydro a.s., Oslo, Norway

[21] Appl. No.: 820,628

[22] PCT Filed: Jul. 11, 1990

[86] PCT No.: PCT/NO90/00116

§ 371 Date: Jan. 23, 1992

§ 102(è) Date: Jan. 23, 1992

[87] PCT Pub. No.: WO91/00789

PCT Pub. Date: Jan. 24, 1991

[30] Foreign Application Priority Data

Jul. 11, 1989 [NO] Norway ..... 892873

[51] Int. Cl.[5] ..... C22C 29/00

[52] U.S. Cl. ..... 75/230; 75/232; 75/236; 75/244; 75/245; 75/246; 75/249; 419/67

[58] Field of Search ..... 419/67; 75/232, 246, 75/249, 236, 244, 230, 245

[56] References Cited

U.S. PATENT DOCUMENTS

| | | | |
|---|---|---|---|
| 4,756,754 | 7/1988 | SinghDeo | 75/233 |
| 4,915,903 | 4/1990 | Brupbacher et al. | 420/129 |
| 4,916,029 | 4/1990 | Nagle et al. | 428/614 |
| 4,916,030 | 4/1990 | Christodoulou et al. | 428/614 |

FOREIGN PATENT DOCUMENTS

| | | |
|---|---|---|
| 0144959 | 6/1985 | European Pat. Off. . |
| 1279332 | 10/1968 | Fed. Rep. of Germany . |
| 2048955A | 12/1980 | United Kingdom . |

*Primary Examiner*—Daniel D. Wasil
*Assistant Examiner*—Ngoclan T. Mai
*Attorney, Agent, or Firm*—Wenderoth, Lind & Ponack

[57] ABSTRACT

Particle reinforced composite material produced by mixing granules of a composite material formed by rapidly solidifying a melt comprising a based light metal matrix and particles of a non-metallic reinforced material with granules of unreinforced host metal matrix, compacting the mixture and applying a shear deformation on said mixture.

8 Claims, 4 Drawing Sheets

PROCESS FOR PRODUCTION OF REINFORCED COMPOSITE MATERIALS AND PRODUCTS THEREOF

The present invention relates to reinforced composite materials and more particularly to a process for the provision of composite alloys reinforced by dispersed particles and the product thereof.

It is known that in order to improve the mechanical properties of metals it is possible to reinforce a metallic matrix with filaments or particles having high characteristics which are insoluble in the base metal. Reinforcing an alloy with ceramic particles, whiskers or fibres yields a material combining the most useful properties of both the metal and the ceramics. The nature and amount of the dispersed particles enable the obtained composite alloys to be adapted to different advanced technical requirements changing besides the mechanical also the physical properties such as thermal expansion, conductivity, magnetic properties etc. of the original alloy.

Such composite alloys can be obtained e.g. by mixing of granulated base metal and reinforcing particles followed by an extrusion process. The resulting materials are, however, liable to several defects like residual porosity and poor homogenity, and consequently a considerable reduction in ductility characterizes such extrusions is experienced.

Furthermore, this powder metallurgy route of manufacturing composites is rather expensive.

Another process, nowadays widely applied for obtaining composite alloys, is based on melting of a base metal and dispersing of particles in a metal matrix in the liquid phase. An intimate mixture of the particles and the molten metal can be obtained using this process. However, it is difficult to avoid sedimentation and segregation phenomena so that the resulting cast composite material may exhibit considerable variations in the desired homogenity, e.g. between the periphery and the interior of a cast block. Furthermore, it has been found that in case of some low ductility alloys the addition of ceramic particles does not result in any significant higher strength in gravity cast specimens.

It is of course possible to use whiskers or continuous fibres as reinforcing means in order to achieve appreciable improvements of the composite characteristics. However, the production costs will also increase so significantly that this is not a real alternative to choose for most applications.

It is therefore the object of the present invention to provide a novel composite material, particularly a metal or metal alloy, reinforced by particles insoluble in the metal matrix and dispersed in a manner resulting in substantially improved characteristics, especially high strength and good ductility of the composite alloys.

The present invention is embodied in a process for preparing a composite material by incorporating particulate non-metallic reinforcement into a molten matrix material followed by a rapid solidification providing an intermediate granulated composite alloy material, mixing of the obtained composite alloy granules with granules of host metal and finally compaction and extruding of the resulting mixture.

The base metal can, for example, be aluminium, magnesium, copper, nickel, titanium or their alloys. As particulate additions particles formed of refractory compounds having high elasticity modulus may be used, such as metal oxides, carbides, silicides or nitrides.

BRIEF DESCRIPTION OF THE DRAWINGS

The present invention will be readily understood and described in more details by means of the following example(s) and by reference to the accompanying drawings, FIGS. 1–6, where.

Light metals, especially aluminium/magnesium and their alloys, have a large potential for substantial improvements in mechanical properties by reinforcing with ceramic particles. Many possible automotive applications for aluminium or magnesium alloys such as pistons, piston pins, connecting rods etc. require higher strength than the commercially available alloys can satisfy. It was therefore natural to consider a possible particle reinforcement of alloys like standard casting alloy of the type AlSi12CuNiMg showing a good strength both at room and elevated temperatures. However, no significant improvement of the alloy properties was achieved in the gravity cast samples reinforced by ceramic particles comprising from 10 to 15 volume % of SiC.

During these trials we have surprisingly found that the strength of such composite materials can be greatly enhanced by a suitable secondary processing of the cast composite material.

EXAMPLES

Commercially available silicon carbide particles of average size 12 μm were added to molten AlSi12-CuNiMg alloy and dispersed through the melt using a modified melt cleaning rotor of the type disclosed in U.S. Pat. No. 4,618,427.

SiC particles were added in an amount of 10–15% to the above alloy. The resulting composite melts were then cast into tensile specimens and billets/ingots for further processing of the particulate reinforced material, namely extrusion of billets to 12 mm diameter test rods and remelting of ingots using a rapid solidification process to provide granules (needles) followed by extrusion of the resulting solidified needles. Tensile testing carried out on more than 100 specimens did not reveal any significant improvement with respect to tensile strength for the reinforced specimens compared to the original alloy at cast condition and at two different commercial heat treatments.

Figure 1:
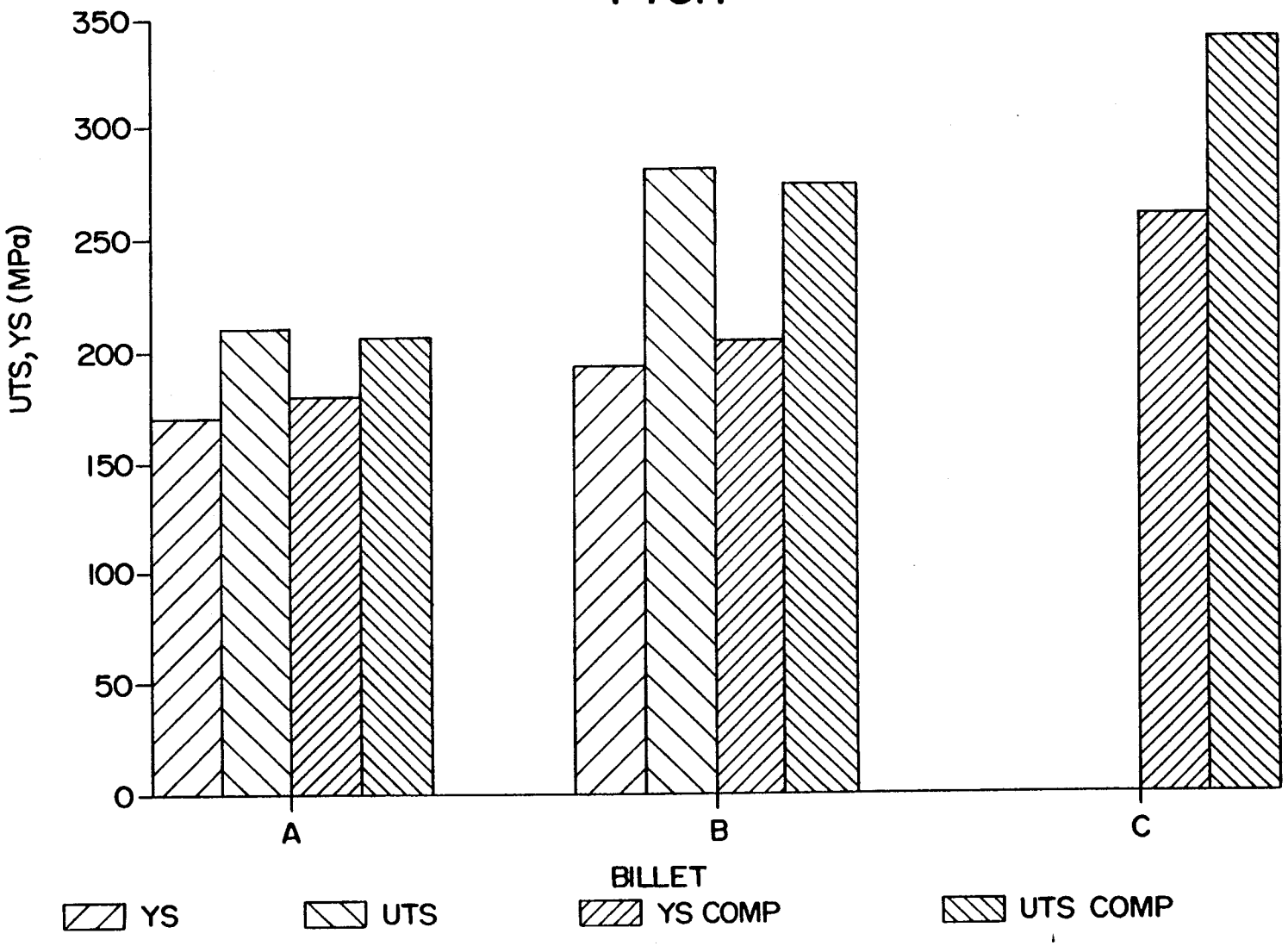
FIG. 1 illustrates graphically the ultimate strength and yield strength of the extruded materials with and without reinforcing particles.

FIG. 1 displays graphically test results from the following examination of extruded samples. The value of the ultimate strength (UTS) and the yield strength (YS) are distinguished by different directions of the hatching and where the higher density of the hatching lines denominates material comprising reinforcing particles (the same distinctions also apply for FIG. 2).

The comparison of tensile strength between extruded specimens from cast billets of the above alloy with and without SiC additions shows only a marginal difference (FIG. 1, area A). The same is true for the UTS and YS for extruded specimens of compacted granules from rapid solidification of the alloy and the reinforced alloy, respectively (FIG. 1, area B). The displayed difference in UTS and YS between the extrusions from cast billets (A) and extrusions from rapidly solidified granules (B) is due to the refined microstructure caused by the rapid solidification process. Apparently, the addition of SiC particles to this brittle aluminium alloy does not improve the material characteristics.

Then needles of the base alloy (host alloy) AlSi12-CuNiMg were mixed with composite needles at approximately equal ratio, compacted and finally extruded as a particle metal matrix composite rods. The applied extrusion ratio 1:35 is identical with the ratios used in all previous experiments and the particle content in the resulting mixed needle extrusion was about 8%. All over the same volume fractions of the particles were maintained.

As disclosed by the diagram in FIG. 1 (area C) a considerable improvement of the tensile properties is achieved, with average yield strength of 260 MPa and average ultimate strength of 340 MPa, respectively. At the same time a good ductility about 4% is maintained as reflected in the difference between yield strength and ultimate tensile strength.

All the test rods have been exposed to a commercial heat treatment comprising holding at 200° C. for a period of 6 hours.

Figure 2:
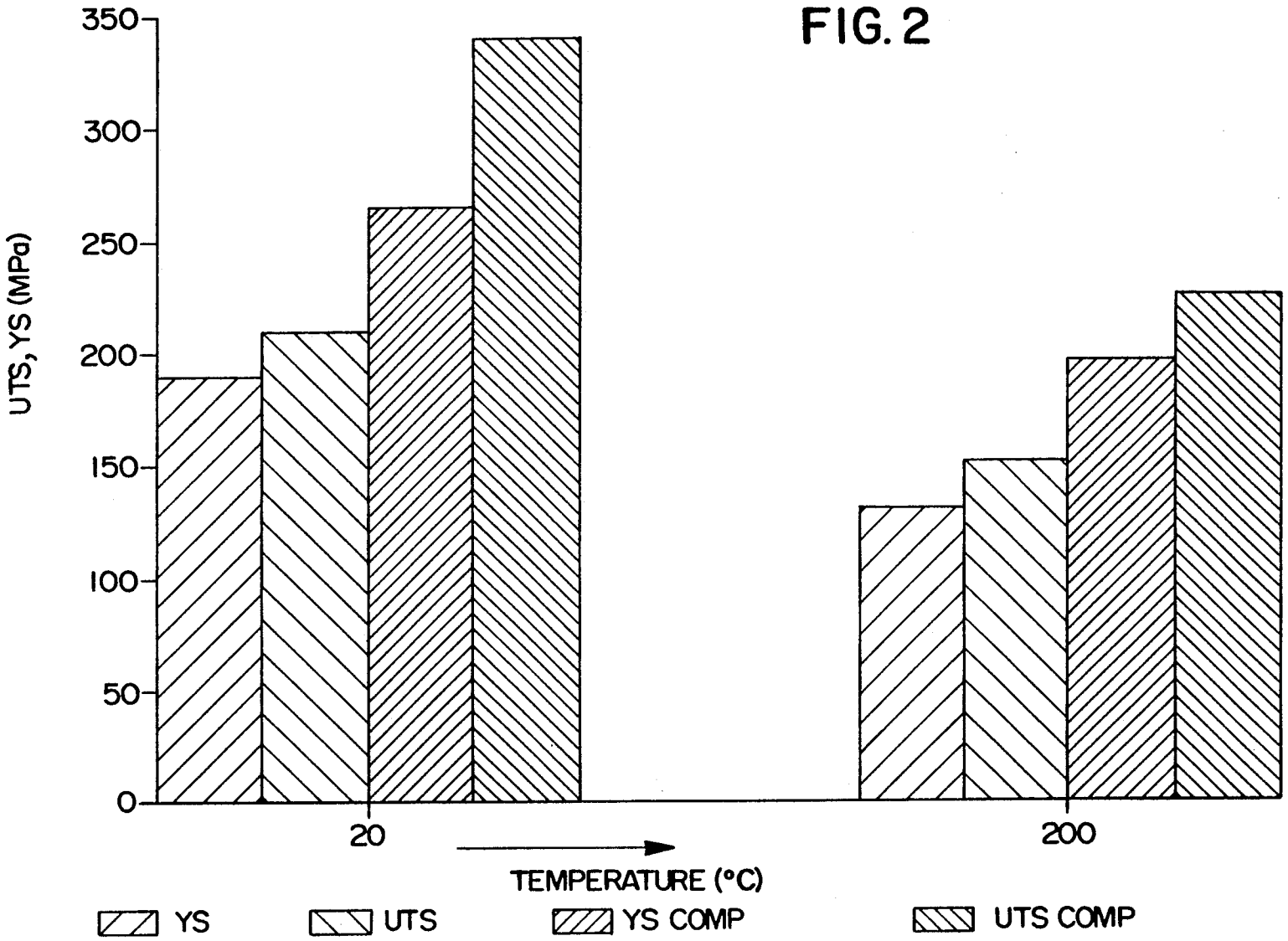
FIG. 2 illustrates the tensile properties of the extrusions at room and elevated temperatures.

FIG. 2 illustrates graphically the even more excellent properties of the extruded rods at elevated temperatures compared to the properties at room temperature. While at room temperature the composite extrusions are about 40% stronger than the unreinforced matrix extrusions, the composite extrusions at 200° C. exhibit an increase of about 50% in the tensile strength compared to the unreinforced base alloy.

The temperature exposure of the specimens prior to testing was relatively short, 20–30 minutes, but the structure is expected to be stabile due to the preceding heat treatment.

As a matter of fact the composite extrusions have practically the same yield and tensile strength at 200° C. as the unreinforced alloy at the same temperature.

Furthermore, besides the improved properties also a much better extrudability was achieved, the extrusion speed being approximately four times higher compared to extrusion of cast composite billets.

Figure 4:
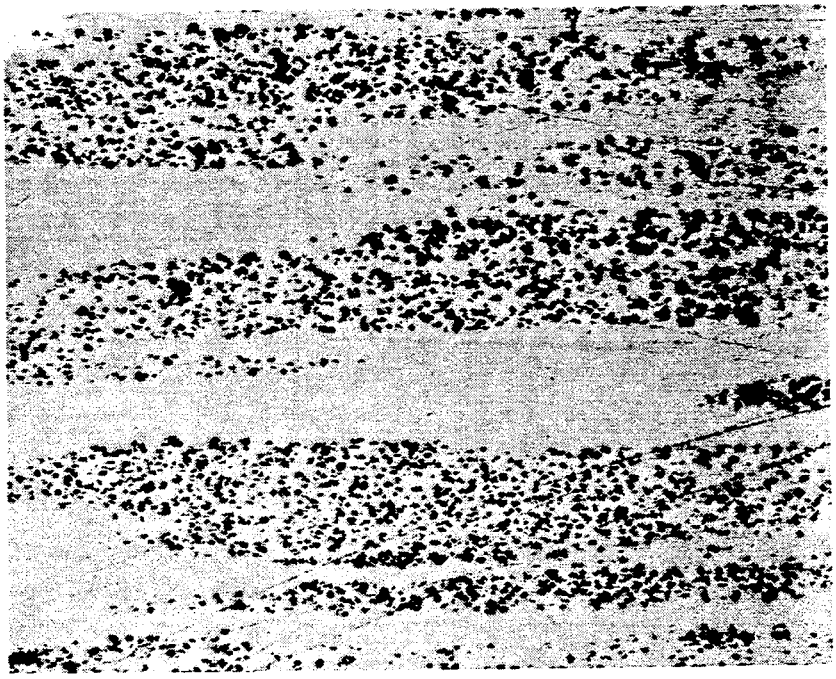
FIG. 4 shows the macrostructure from FIG. 3 at higher magnification (50×)
Figure 3:
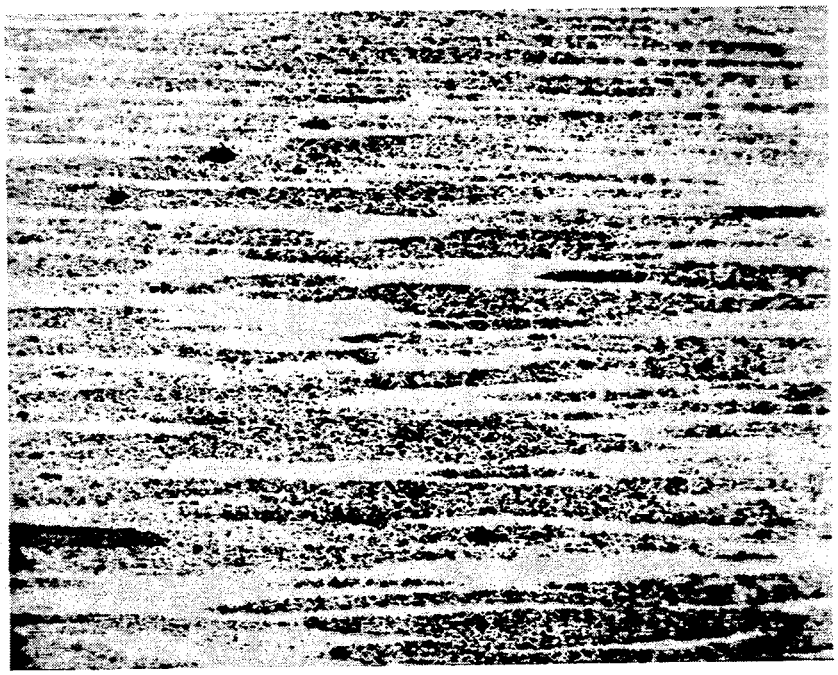
FIG. 3 shows in a cross-sectional longitudinal view a photo of the extruded reinforced composite alloy material macrostructure (magnification 13,6)
Figure 5:
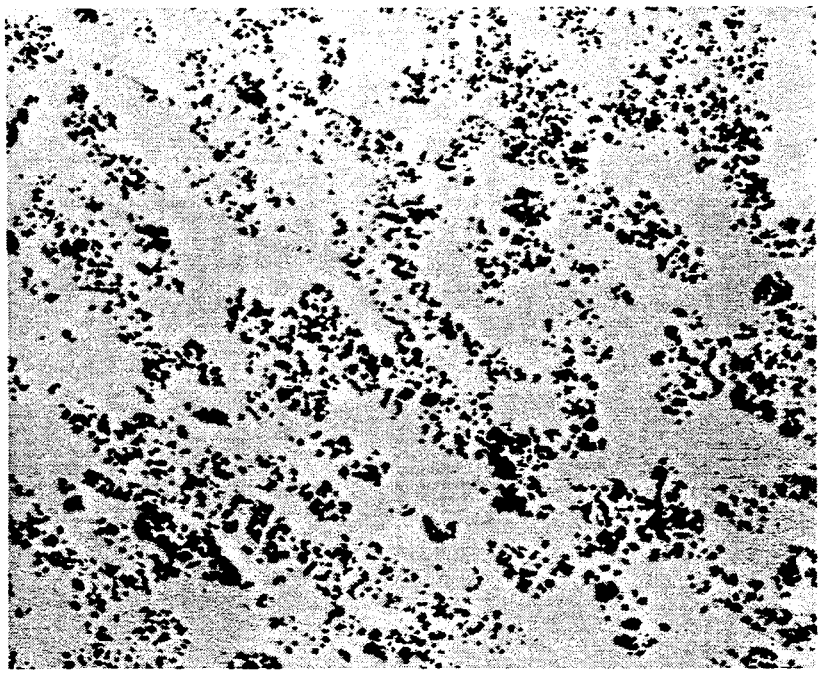
FIG. 5 illustrates the distribution pattern of the reinforcing particles taken at the plan perpendicular to the extrusion direction.

This extraordinary and surprising strengthening effect seems to be caused by a special distribution of the reinforcing particles as illustrated in FIGS. 3–5. Contrary to the hitherto known composite materials requiring a homogeneous distribution of the reinforcing particles in the matrix the extrusions resulting from the mixing of reinforced/unreinforced needles according to the invention exhibit a heterogeneous distribution of the particles characterized by unidirectional arrangement of discontinuous heavily deformed and particle enriched zones in the metal matrix.

FIG. 3 shows a macrostructure of the extrusion in a vertical longitudinal cross-sectional view, and FIG. 4 is the same macrostructure revealing more details by higher magnification of the photographic picture. The pictures show a heterogeneous structure composed of discontinuous heavily deformed particle enriched zones embedded in the metal matrix. The zones are extending parallelly longitudinally through the extrusion in the direction of the material flow caused by the applied solid forming process (extrusion).

This unidirectional arrangement of the discontinuous particle enriched zones produces a hard and tough material where the metal matrix areas between the zones arrest crack propagation. There are no distinct interfaces between the essentially particle free matrix and the particle enriched zones so that the composite materials according to the present invention achieve a perfect bonding of particle enriched deformed zones to the base metallic material.

Figure 6:
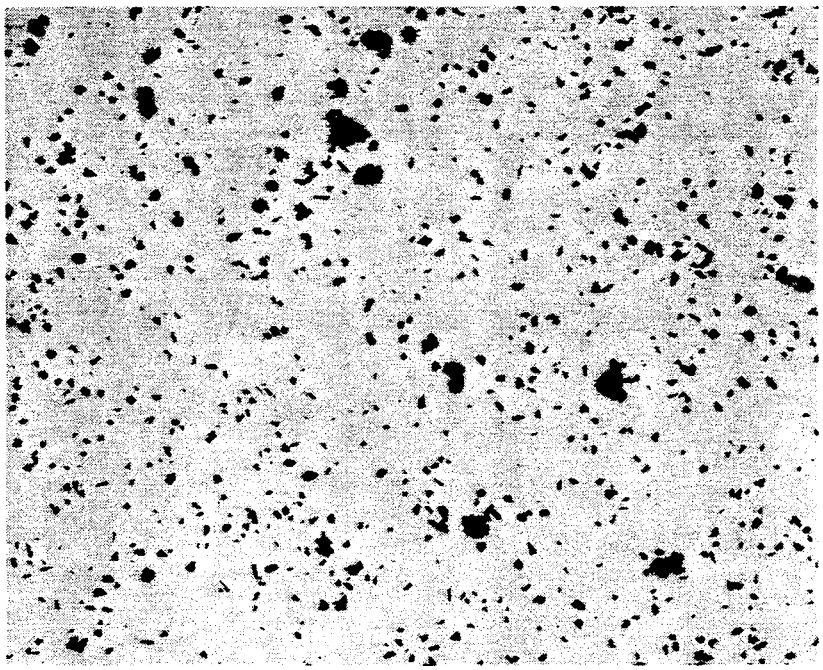
FIG. 6 is a macrostructural longitudinal cross-sectional picture of a reference extrusion.

FIG. 5 illustrates the unhomogeneous distribution pattern of the reinforcing particles in a vertical cross-section perpendicularly to the extrusion direction. A typical homogeneous distribution of the reinforcing particles resulting from extrusion of particle reinforced cast billets is shown as a reference in FIG. 6.

While the invention has been described in terms of preferred embodiments it is apparent that modifications may be made therein without departing from the spirit or scope of the invention as set forth in the appended claims. Other solid forming processes than the disclosed extrusion can be applied, e.g. forging, die forging or rolling. Consequently, other configurations of the discontinuous particle enriched zones than the unidirectional arrangement resulting from the extrusion process will be achieved according to the resulting prevailing direction of the material flow.

Ceramic materials may also be used as the molten matrix, and other types of reinforcing particles than the disclosed refractory compounds may be used, e.g. carbon particles.

Furthermore, apart from granulation of rapidly solidified melts, a mechanical granulation of the particle reinforced composite material and/or the host matrix material may be applied prior to the mixing and compacting steps of the process according to the present invention.

The applied host matrix material (alloy) may have the same composition as the base material matrix of the intermediate granulated composite material, as disclosed by the way of example using AlSi12CuNiMg alloy, or two different matrix materials (alloys) can be used in order to achieve the particular properties of the resulting composite material.

The solid forming deformation process can be an extrusion process where the amount of the composite granules is in the range of from 15 to 85%, preferably 40–60%, of the total amount of the composite granules and the host matrix granules.

We claim:

1. Process for preparing a composite material comprising a base light metal matrix reinforced by dispersed particles to improve the mechanical properties of the material, wherein said process comprises the steps of incorporating particulate non-metallic reinforcement into a molten light metal matrix material, rapidly solidifying the melt to provide granules or needles of composite material, providing granules of an unreinforced host metal matrix, mixing the granules of the composite material and the host material in a predetermined ratio, compacting the mixed granules and finally, applying a shear deformation solid forming process on the compacted mixture of granules.

2. The process according to claim 1, wherein the host matrix material has substantially the same composition as the base matrix of the composite material.

3. The process according to claim 1, wherein the solid forming deformation process is an extrusion process where the amount of the composite granules is in the range of from 15 to 85% of the total amount of the composite granules and the host matrix granules.

4. The process according to claim 9, wherein the amount of the composite granules is in the range of from 40 to 60%.

5. The process according to claim 1, wherein the granules are provided by a rapid solidification of molten materials.

6. A particle reinforced composite material comprising a base light metal matrix prepared by the process according to any of claims 1, 2, 5 or 4, wherein the composite material exhibits a heterogeneous macrostructure comprising discontinuous heavily deformed particle enriched zones in a substantially particle free matrix.

7. The composite material according to claim 6, wherein the material comprises an aluminium alloy reinforced by ceramic particles and exhibits up to 50% higher strength than the base alloy material at a temperature of 200° C.

8. The composite material according to claim 6, wherein the discontinuous particle enriched zones extend unidirectionally.

* * * * *